US008794824B2

(12) United States Patent
Hirayama

(10) Patent No.: US 8,794,824 B2
(45) Date of Patent: Aug. 5, 2014

(54) CASE UNIT WITH OPENING COVERED WITH LIGHT TRANSMISSION MEMBER, PORTABLE APPARATUS INCLUDING SUCH CASE UNIT, AND METHOD FOR ASSEMBLING SUCH CASE UNIT

(75) Inventor: Sen Hirayama, Urayasu (JP)

(73) Assignee: Casio Computer Co., Ltd, Tokyo (JP)

( * ) Notice: Subject to any disclaimer, the term of this patent is extended or adjusted under 35 U.S.C. 154(b) by 114 days.

(21) Appl. No.: 13/242,975

(22) Filed: Sep. 23, 2011

(65) Prior Publication Data

US 2012/0075964 A1 Mar. 29, 2012

(30) Foreign Application Priority Data

Sep. 29, 2010 (JP) ..... 2010-219014

(51) Int. Cl.

| | |
|---|---|
| ***G04B 39/00*** | (2006.01) |
| ***G04B 37/08*** | (2006.01) |
| ***G04B 37/22*** | (2006.01) |
| ***G04B 39/02*** | (2006.01) |

(52) U.S. Cl.

CPC ..... *G04B 37/084* (2013.01); *G04B 37/225* (2013.01); *G04B 39/02* (2013.01)

USPC ..... 368/294; 368/296

(58) Field of Classification Search

CPC ..... G04B 37/084; G04B 37/225; G04B 39/02

USPC ..... 368/287, 291, 294–296

See application file for complete search history.

(56) References Cited

U.S. PATENT DOCUMENTS

| | | | | |
|---|---|---|---|---|
| 3,643,423 | A * | 2/1972 | Piquerez | 368/287 |
| 4,132,062 | A * | 1/1979 | Fujimori | 368/309 |
| 4,487,513 | A * | 12/1984 | Matsumoto | 368/294 |
| 4,975,893 | A * | 12/1990 | Dal Busco | 368/294 |
| 6,213,635 | B1 * | 4/2001 | Savy et al. | 368/299 |
| 6,616,329 | B1 * | 9/2003 | Sasaki et al. | 368/294 |
| 6,762,976 | B1 * | 7/2004 | Tamaru et al. | 368/88 |
| 7,182,508 | B2 * | 2/2007 | Bertrand et al. | 368/295 |
| 2008/0025158 | A1 * | 1/2008 | Hiranuma et al. | 368/308 |

FOREIGN PATENT DOCUMENTS

| | | |
|---|---|---|
| CN | 1288533 | 3/2001 |
| JP | 2000-329869 | 11/2000 |

OTHER PUBLICATIONS

Notification of the First Office Action for Chinese Application 2011103483753 Dated Feb. 4, 2013, 21 pgs.

* cited by examiner

*Primary Examiner* — Vit W Miska

(74) *Attorney, Agent, or Firm* — Amin, Turocy & Watson, LLP

(57) ABSTRACT

A case unit includes a resin case main body including an outer peripheral surface and an opening forming surface enclosed by the outer peripheral surface and being formed with an opening. A step is provided on an inner peripheral surface of the opening to face an entrance of the opening. An elastic member is provided along the inner peripheral surface of the opening and mounted on the step. A light transmission member is press-fitted in the opening via the elastic member and covers the opening. And, a fitting part of a frame member is fitted on the outer peripheral surface of the resin case main body to make an elastic member pressing part extending from the fitting part toward the entrance of the frame member cover at least a part of the elastic member at the entrance of the opening.

13 Claims, 5 Drawing Sheets

CASE UNIT WITH OPENING COVERED WITH LIGHT TRANSMISSION MEMBER, PORTABLE APPARATUS INCLUDING SUCH CASE UNIT, AND METHOD FOR ASSEMBLING SUCH CASE UNIT

CROSS-REFERENCE TO RELATED APPLICATIONS

This application is based upon and claims the benefit of priority from prior Japanese Patent Application No. 2010-219014, filed Sep. 29, 2010, the entire contents of which are incorporated herein by reference.

BACKGROUND OF THE INVENTION

1. Field of the Invention

The present invention relates to a case unit with an opening covered with a light transmission member, a portable apparatus including such a case unit, and a method for assembling such a case unit.

2. Description of the Related Art

As a case unit with an opening covered with a light transmission member, there are known, for example, a case unit for a time piece including a wristwatch, a case unit for a cellular phone, a case unit for a PDA (Personal data assistance), a case unit for a portable audio player, a case unit for a portable or small-size radio and the like.

For example, a conventional case unit for a wristwatch is described in Japanese Patent Application KOKAI Publication No. 2000-329869.

The conventional, case unit for a wristwatch comprises a metal case having a watch module storage space which stores a watch module with a plurality of watch hands for indicating a time, and a watch glass as a light transmission member which covers an entrance opening of the watch module storage space of the metal case and through which the watch hands of the watch module can be seen from an outside of the metal case. The watch glass is fitted in the entrance opening with a watch glass fixing and waterproofing packing between an outer peripheral surface of the watch glass and an inner peripheral surface of the entrance opening of the watch module storage space. Further, an outer peripheral area on an external surface of the watch glass is covered with an annular bezel which is placed at an entrance opening peripheral area that encloses the entrance opening of the watch module storage space on an external surface of the metal case, and the annular bezel is fixed to the entrance opening peripheral area on the external surface of the metal case by fixing screws.

The metal case is relatively heavy, and a process thereof is complicated and comparatively expensive. Furthermore, the fixing screws that are used for fixing the watch glass together with the watch glass fixing and waterproofing packing to the entrance opening of the watch module storage space of the metal case complicates a watch glass fixing structure of the conventional case unit for a wristwatch and further complicates an assembling of the conventional case unit for a wristwatch.

There was a proposal in which the annular bezel is fixed to the entrance opening peripheral area on the external surface of the metal case by using a double-coated adhesive tape instead of the fixing screws. However, after a long time use or in an exposure test to a high temperature for a long time, a performance of the double-coated adhesive tape was deteriorated.

A wristwatch using a synthetic resin case instead of the metal case is conventionally used. Since an elasticity of the synthetic resin case is higher than that of the metal case, in order to prevent the watch glass together with the watch glass fixing and waterproofing packing from being easily fallen from the entrance opening of the watch module storage space of the synthetic resin case when the synthetic resin case receives an impact from its outside, after it is used for a long time period, or in an exposure test to a high temperature for a long time, a watch glass fixing structure such as, for example, the annular bezel using the fixing screws as described above, which has a physically high durability but has a complicated structure whose assembly is cumbersome, must be employed.

The present invention has been derived from the above described circumstances, and an object of the present invention is to provide a case unit with an opening covered with a light transmission member, which has an simple structure, which is easy to be assembled and, even if a synthetic resin case, which is inexpensive and whose production cost is inexpensive, is used instead of a metal case, which can prevent a light transmission member from being easily fallen from the synthetic resin case after a long time period or in an exposing test to a high temperature for a long time. And another object of the present invention is to provide a portable apparatus including such a case unit with an opening covered with a light transmission member, and a method for assembling such a case unit with an opening covered with a light transmission member.

BRIEF SUMMARY OF THE INVENTION

In order to achieve the above described object of the present invention, a case unit according to one aspect of the present invention comprises: a resin case main body which includes an outer peripheral surface, and an opening forming surface enclosed by the outer peripheral surface and being formed with an opening; a step which is provided on an inner peripheral surface of the opening of the resin case main body and which faces an entrance of the opening; an elastic member which is provided along the inner peripheral surface of the opening of the resin case main body and which is mounted on the step; a light transmission member which includes an outer periphery, which is press-fitted in the opening of the resin case main body with the elastic member being interposed between the outer periphery of the light transmission member and the inner peripheral surface of the opening of the resin case main body, and which covers the opening; and a frame member which includes a fitting part fitted on the outer peripheral surface of the resin case main body and an elastic member pressing part extending from the fitting part towards the entrance of the opening of the resin case main body and covering at least a part of the elastic member at the entrance of the opening.

In order to achieve the above described object of the present invention, a portable apparatus according to one aspect of the present invention comprises: a case unit having an opening; a function unit stored in the opening of the case unit; and a light transmission member having an outer periphery and covering the opening of the case unit. The case unit comprises: a resin case main body which includes an outer peripheral surface, and an opening forming surface enclosed by the outer peripheral surface and being formed with the opening; a step which is provided on an inner peripheral surface of the opening of the resin case main body and which faces an entrance of the opening; an elastic member which is provided along the inner peripheral surface of the opening of the resin case main body, which is mounted on the step, which is pressed by the outer periphery of the light transmission member when the light transmission member is press-fitted in the opening to cover the opening, and which is interposed between the outer periphery of the light transmission member and the inner peripheral surface of the opening of the resin case main body; and a frame member which includes a fitting part fitted on the outer peripheral surface of the resin case main body and an elastic member pressing part extending from the fitting part towards the entrance of the opening of the resin case main body and covering at least a part of the elastic member at the entrance of the opening.

In order to achieve the above described object of the present invention, a method for assembling a case unit according to one concept of the present invention comprises: preparing a resin case main body which includes an outer peripheral surface, an opening forming surface enclosed by the outer peripheral surface and being formed with an opening, and a step provided on an inner peripheral surface of the opening and facing an entrance of the opening; preparing a frame member which includes a fitting part to be fitted on the outer peripheral surface of the resin case main body and an elastic member pressing part which extends from the fitting part towards the entrance of the opening of the resin case main body and which overhangs the entrance of the opening, when the fitting part is fitted on the outer peripheral surface of the resin case main body; performing one of mounting an elastic member which is configured to be provided along the inner peripheral surface of the opening of the resin case main body, on the step, and fitting the fitting part of the frame member on the outer peripheral surface of the resin case main body; performing the other of the mounting of the elastic member on the step, and the fitting the fitting part of the frame member on the outer peripheral surface of the resin case main body, so that at least a part of the elastic member is covered with the elastic member pressing part of the frame member at the entrance of the opening; and press-fitting a light transmission member which includes an outer periphery, in the opening of the resin case main body with the elastic member being interposed between the outer periphery of the light transmission member and the inner peripheral surface of the opening of the resin case main body, to cover the opening.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated herein and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
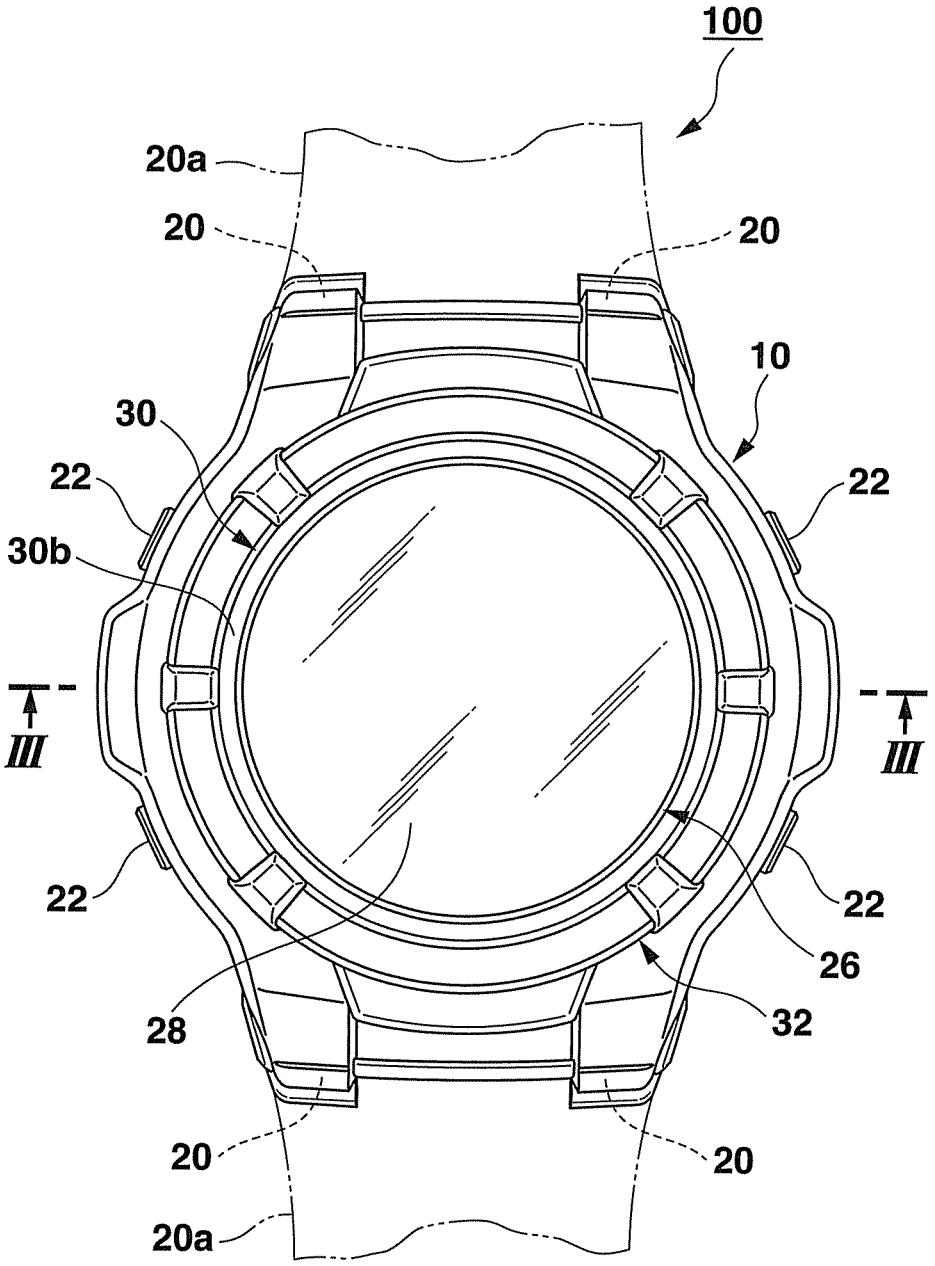
FIG. 1 is a schematic plan view of a wrist watch as one kind of portable apparatus including a case unit with an opening covered with a light transmission member, each of the wrist watch and the case unit being in accordance with one embodiment of the present invention.
Figure 2:
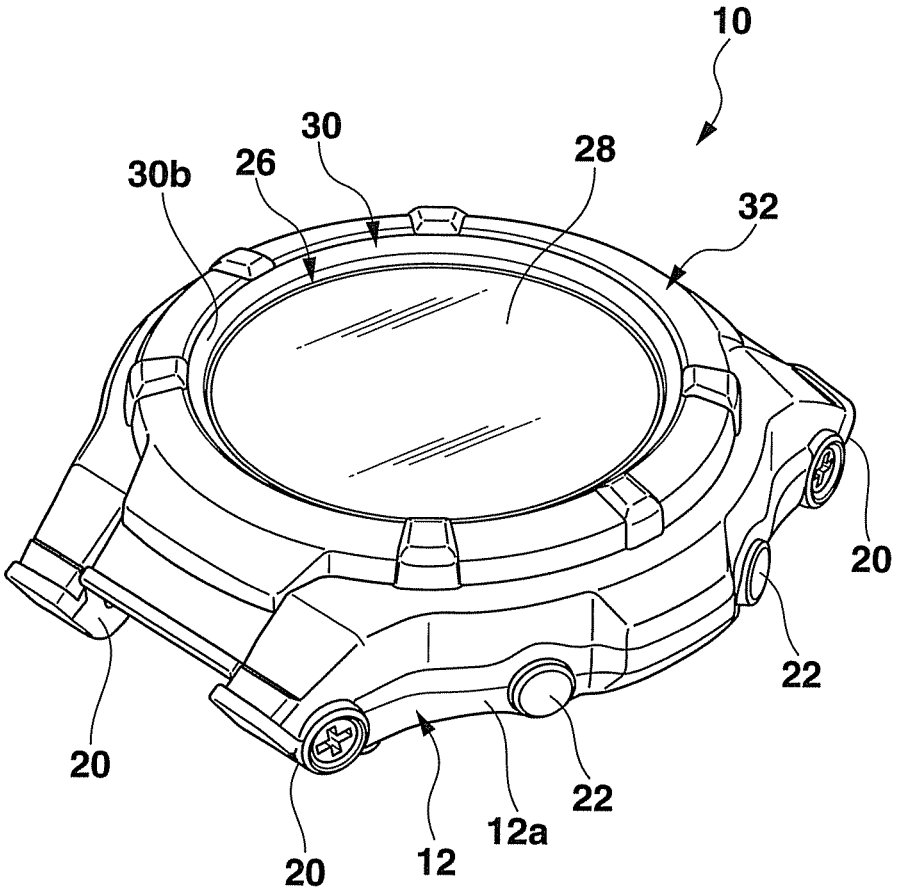
FIG. 2 is a schematic perspective view of the case unit of FIG. 1.
Figure 3:
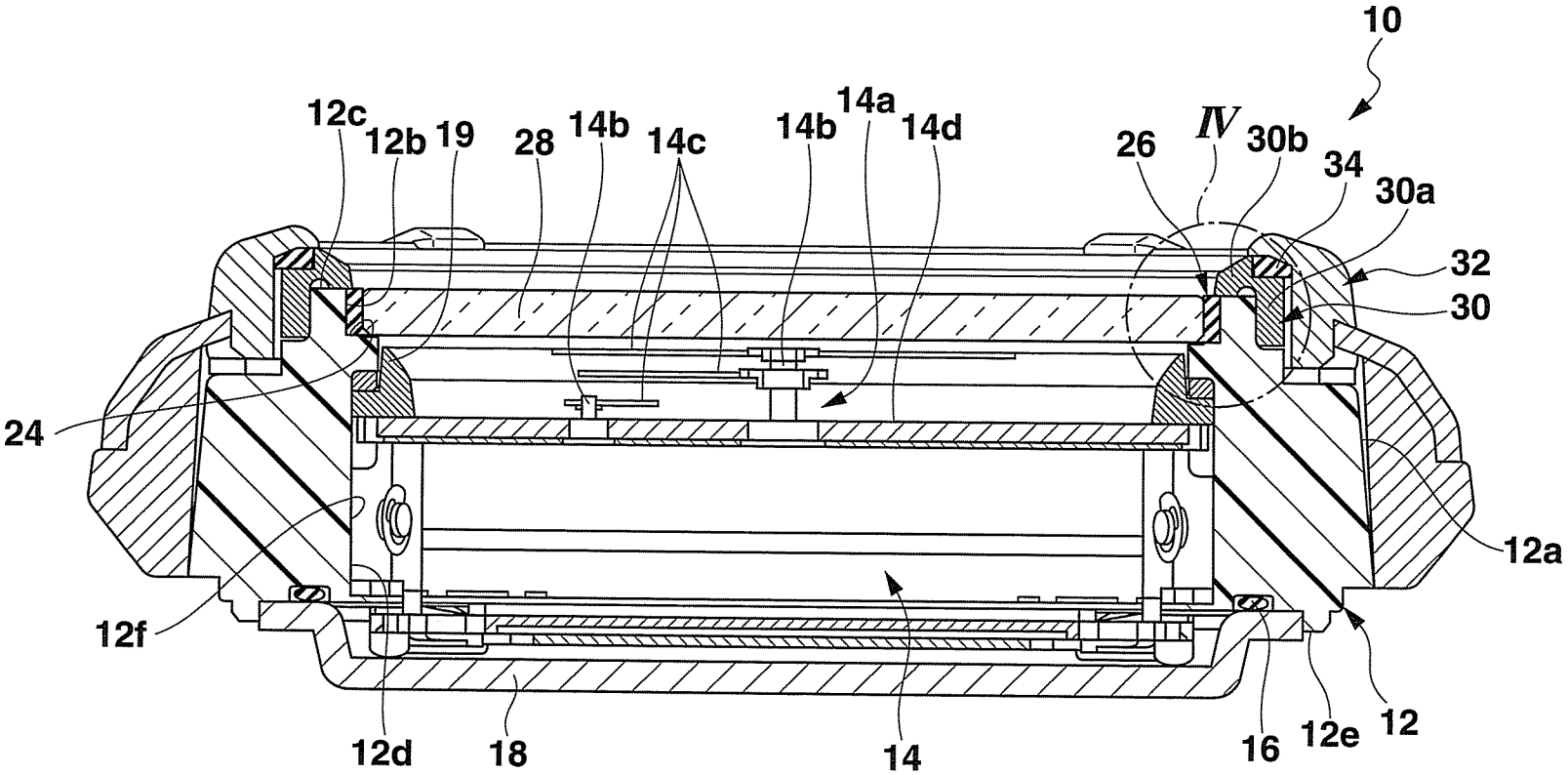
FIG. 3 is a schematic sectional view along a line III-III of FIG. 1.

As illustrated in FIG. 1 to FIG. 3, a case unit 10 for a wristwatch 100 as one kind of a portable apparatus according to one embodiment of the present invention comprises a resin case main body 12 which includes an outer peripheral surface 12*a*, and an opening forming surface 12*c* enclosed by the outer peripheral surface 12*a* and being formed with an opening 12*b*. In the present embodiment, the resin case main body 12 is integrally molded by, for example, ABS (Acrylonitrile Butadiene Styrene) resin. Further, the wristwatch 100 is one kind of portable watch, and the portable watch is one kind of portable time piece.

In the present embodiment, the resin case main body 12 is formed into a substantially disk shape. One side surface of the disk-shaped resin case main body 12 provides the opening forming surface (a top surface in this embodiment) 12*c* which is formed with the opening 12*b*, while the other side surface of the disk-shaped resin case main body 12 provides a back surface 12*e* which is formed with another opening 12*d* communicated with the opening 12*b*.

In the resin case main body 12, a space between the opening 12*b* of the opening forming surface 12*c* and the other opening 12*d* of the back surface 12*e* provides a storage space 12*f*. In the storage space 12*f*, a known watch module 14 as one kind of time piece module and also as one kind of function unit is inserted through the opening 12*d* of the back surface 12*e* of the resin case main body 12 and stored therein. The opening 12*d* of the back surface 12*e* is covered with a back cover 18 with a waterproof ring 16, and the back cover 18 is detachably fixed to the back surface 12*e* by a known fixing means such as, for example, fixing screws. In the present embodiment, the back cover 18 is made of a corrosion-resistance metal such as, for example, stainless steel, titanium, and the like.

The watch module 14 includes, for example, a known time measuring unit which is not illustrated, a known power source such as a battery, which is not illustrated, for the time measuring unit, and a known display unit 14*a* for displaying a time measured by the time measuring unit. In the storage space 12*f*, the display unit 14*a* of the watch module 14 faces the opening 12*b* of the opening forming surface 12*c*.

In the storage space 12*f* of the resin case main body 12, the watch module 14 is sandwiched between the back cover 18 and a positioning ring (a boundary ring) 19 which is positioned at a predetermined position adjacent to the opening 12*b* of the opening forming surface 12*c* so as not to move towards the opening 12*b*, and is retained at the predetermined position in the storage space 12*f*.

In the watch module 14 of the present embodiment, the time measuring unit is provided with a control circuit for carrying out various functions other than the time measurement, and the functions carried out by the control circuit can be displayed on the display unit 14*a*.

The display unit 14*a* of the watch module 14 of the present embodiment includes a plurality of indicating hands 14*c* (including an hour hand, a minute hand, a second hand and the like) fixed to projecting ends of a plurality of indicating hand drive shafts 14*b* which project from the time measuring unit, and a dial plate or an information display plate 14*d* which is located at the proximal end side of the indicating hand drive shafts 14*b* and displays various pieces of information including a time in cooperation with the indicating hands 14*c*.

The display unit 14*a* may further include a known symbol display device such as, for example, a liquid crystal display device, in the dial plate or the information display plate 14*d*. Alternately, the display unit 14*a* may include only the known symbol display device such as, for example, the liquid crystal device, without the indicating hand drive shafts 14*b* or the indicating hands. The dial plate or the information display plate 14*d* can be combined with a solar battery.

A pair of watch band attaching projections 20 is provided at each of two predetermined parts located on the outer peripheral surface 12*a* of the resin case main body 12 separated from each other at substantially 180°. A plurality of operation buttons 22 for controlling the above described control circuit of the watch module 14 stored in the storage space 12*f* of the resin case main body 12 is further arranged at a plurality of parts on the outer peripheral surface 12*a* of the resin case main body 12 other than the above described two parts.

A step 24 is formed at a position on the inner peripheral surface of the opening 12*b* of the opening forming surface 12*c* of the resin case main body 12, the position being closer to the entrance of the opening 12*b* with respect to the display unit 14*a* of the watch module 14 and the positioning ring (the boundary ring) 19, to face the entrance of the opening 12*b*. The step 24 is illustrated in detail in FIG. 4.

An annular elastic member 26 is mounted on the step 24 to be provided along the inner peripheral surface of the opening 12*b*. The elastic member 26 can be made of, for example, nitrile rubber (NBR: nitrile butadiene rubber), fluoro rubber (FKM), polyurethane rubber (U), silicone rubber (VMQ), ethylene propylene rubber (EPDM), hydrogenated nitrile rubber (HNBR), chloroprene rubber (CR), acrylic rubber (ACM), butyl rubber (IIR: isobutylene-isoprene rubber), or the like.

A light transmission member 28 which covers the opening 12*b*, together with the elastic member 26, is press-fitted in the opening 12*b* of the opening forming surface 12*c* of the resin case main body 12. In the present embodiment, the above described press-fitting is performed by using, for example, an air press machine. A diameter of an inner periphery of the elastic member 26 is smaller than that of an outer periphery of the light transmission member 28. By the press-fitting, the elastic member 26 is compressed in a radial direction of the opening 12*b*, and is further pushed towards a surface of the step 24. As a result, the outer periphery of the light transmission member 28 is brought into close contact with the inner periphery of the annular elastic member 26, an outer periphery of the annular elastic member 26 is brought into close contact with the inner peripheral surface of the opening 12*b*, and furthermore a basal part of the annular elastic member 26 is brought into close contact with the surface of the step 24 of the inner peripheral surface of the opening 12*b*. The compressed elastic member 26 increases its friction resistance to the light transmission member 28 and the inner peripheral surface of the opening 12*b* to prevent the light transmission member 28 from falling out from the opening 12*b* of the opening forming surface 12*c* of the resin case main body 12.

It is preferable that the opening forming surface 12*c* of the resin case main body 12, an outer side surface of the press-fitted light transmission member 28 facing an outer space, and an outer side part of the elastic member 26 facing the outer space are arranged to be substantially flush with one another.

In the present embodiment, the light transmission member 28 is a so-called watch glass, and the watch glass may be transparent or may be colored in various colors.

Figure 4:
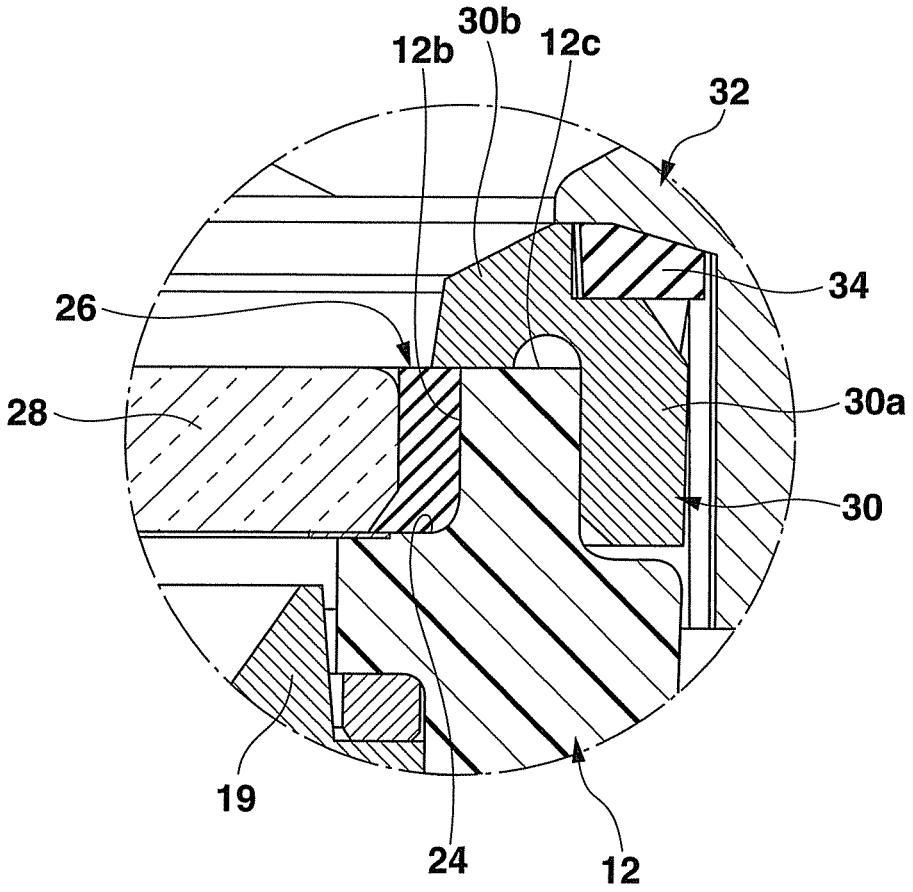
FIG. 4 is a schematic enlarged view of a part IV of FIG. 3.
Figure 5:
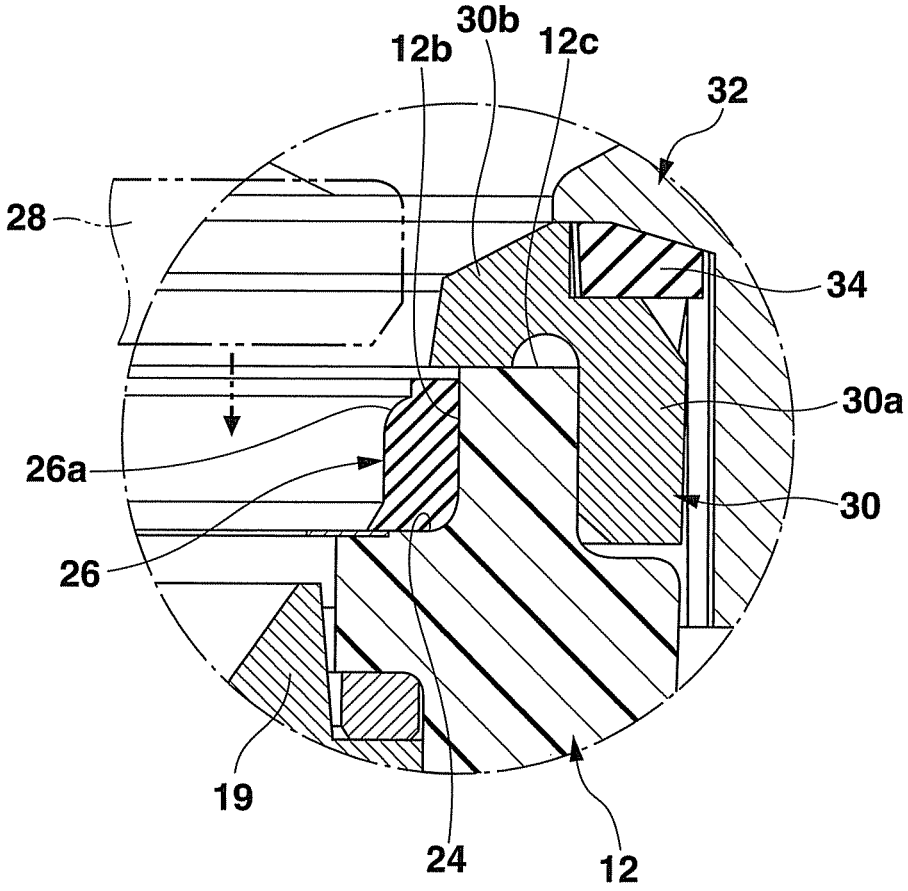
FIG. 5 is a schematic enlarged view similar to FIG. 4, but illustrates a state immediately before a watch glass as one kind of the light transmission member together with an elastic member is press-fitted in an entrance opening of a watch module storage space of a case body of the case unit.

In the present embodiment, in order to facilitate the above described press-fitting and to eliminate any possibility that a part of the inner periphery of the elastic member 26 in a side of the opening forming surface 12*c* of the resin case main body 12 is damaged by the press-fitting, the part of the inner periphery of the elastic member 26 in the side of the opening forming surface 12*c* of the resin case main body 12 is shaped into an inclined or curved surface 26*a* to expand radially outwardly from the other part of the inner periphery of the elastic member 26 and to have a larger diameter than a diameter of the outer periphery of the light transmission member 28, before the press-fitting, as illustrated in FIG. 5. The inclined or curved surface 26*a* of the part of the inner periphery of the elastic member 26 is crushed by the press-fitting, as illustrated in FIG. 4.

A fitting part 30*a* of a frame member 30 is fitted on a part of the outer peripheral surface 12*a* of the resin case main body 12, the part located adjacent to the opening forming surface 12*c*. The frame member 30 further includes an elastic member pressing part 30*b* which extends from the fitting part 30*c* towards the opening 12*b* of the opening forming surface 12*c* of the resin case main body 12 to overhang the entrance of the opening 12*b* and which covers at least a part of the elastic member 26 at the entrance. The fitting part 30*a* and elastic member pressing part 30*b* of the frame member 30 may be integrally formed by the same material. The elasticity of the material of the frame member 30 is smaller than that of the material of the resin case main body 12, and the material of the frame member 30 is a metal such as, for example, stainless steel in this embodiment.

An essential or substantial function of the fitting part 30*a* of the frame member 30 is to surely prevent the opening 12*b* of the resin case main body 12 from expanding outwardly in its radial direction after the light transmission member 28 together with the elastic member 26 is press-fitted in the opening 12*b*, for a long time period and in the above described known exposure test to a high temperature for a long time.

Another essential or substantial function of the fitting part 30*a* is to surely prevent the fitting part 30*a* of the frame member 30 from falling out from the part of the outer peripheral surface 12*a* of the resin case main body 12, the part located adjacent to the opening forming surface 12*c*, even when any ordinarily possible impact is applied to the frame member 30 from the outside thereof.

In other words, the essential or substantial function thereof is to surely prevent the light transmission member 28 from falling out from the opening 12*b* of the resin case main body 12 for a long time period, in the above described known exposure test to a high temperature for a long time, and even when any ordinarily possible impact is applied to the frame member 30 from the outside thereof. Therefore, at least the fitting part 30*a* of the frame member 30 should be made of such a material that can carry out the above described essential or substantial function and should be formed into such a shape that can carry out the above described essential or substantial function. Furthermore, in the present embodiment, the above described fitting is performed by, for example, a press-fitting using an air press machine.

A portion of an outer surface of the elastic member pressing part 30*b* of the frame member 30, the portion being visible when the outer surface of the elastic member pressing part 30*b* is viewed from the outside of the opening forming surface 12*c* of the resin case main body 12, may be decorated.

In the present embodiment, each of the fitting part 30*a* and the elastic member pressing part 30*b* of the frame member 30 has an annular shape extending annularly along the circumferential edge of the entrance of the opening 12*b* of the resin case main body 12. However, as long as the fitting part 30*a* can carry out the above described essential or substantial function, it may be that either one of the fitting part 30*a* and the elastic member pressing part 30*b* has the annular shape and the other is divided into a plurality of pieces at a plurality of positions spaced apart from each other in a circumferential direction of the annular shaped one.

In the present embodiment, the elastic member pressing part 30*b* of the frame member 30 covers at least ½ of the dimension of the elastic member 24 in a direction directing from the circumferential edge of the entrance of the opening 12*b* of the resin case main body 12 towards a center of the entrance of the opening 12*b*. However, the elastic member pressing part 30*b* of the frame member 30 may cover the overall dimension of the elastic member 24 in the above described direction.

An essential or substantial function of the elastic member pressing part 30*b* of the frame member 30 is to surely prevent the light transmission member 28 from falling out from the opening 12*b* of the resin case main body 12 in cooperation with the fitting part 30*a*. Therefore, as long as the elastic member pressing part 30*b* of the frame member 30 can carry out its above described essential or substantial function, the elastic member pressing part 30*b* of the frame member 30 may cover less than ½ of the dimension of the elastic member 24 in the direction directing from the circumferential edge of the entrance of the opening 12*b* of the resin case main body 12 towards the center of the entrance of the opening 12.

In the present embodiment, an outer peripheral surface of the fitting part 30*a* of the frame member 30, an outward surface of the elastic member pressing part 30*b* of the frame member 30, the outward surface facing outward opposite to the opening forming surface 12*c* of the resin case main body 12, and the outer peripheral surface 12*a* of the resin case main body 12 are covered with an exterior member 32.

The exterior member 32 can be formed into a desired shape by a desired material, and is fixed to the outer peripheral surface 12*a* of the resin case main body 12 by a desired fixing member.

In the present embodiment, the exterior member 32 is placed on the above described outward surface of the elastic member pressing part 30*b* of the frame member 30 with an annular shaped impact cushioning member 34 such as, for example, a polyurethane rubber, being interposed between them. However, in place of the annular shaped impact cushioning member 34, a plurality of impact cushioning pieces may be provided at a plurality of positions on the above described outward surface of the elastic member pressing part 30*b* of the frame member 30, the positions being separated from each other in the circumferential direction of the fitting part 30*a* of the frame member 30.

Next, an example of a method for assembling the case unit 10 described above with reference to from FIG. 1 to FIG. 4, according to one embodiment of the present invention will be described below.

In this assembling method, the disk-shaped resin case main body 12 which includes the outer peripheral surface 12*a*, the opening forming surface 12*c* enclosed by the outer peripheral surface 12*a* and being formed with the opening 12*b*, and the step 24 provided on the inner peripheral surface of the opening 12*b* and facing the entrance of the opening 12*b* is prepared. The resin case main body 12 further comprises the other opening 12*d* in the back surface 12*e* thereof, and the other opening 12*d* communicates with the opening 12*b* of the opening forming surface 12*c*. In the resin case main body 12, the storage space 12*f* is provided between the opening 12*d* of the back surface 12*e* and the opening 12*b* of the opening forming surface 12*c*.

Also, the frame member 30 which includes the fitting part 30*a* to be fitted on the outer peripheral surface 12*a* of the resin case main body 12 is prepared. The frame member 30 further includes the elastic member pressing part 30*b* extending from the fitting part 30*a* towards the entrance of the opening 12*b* of the resin case main body 12 and overhanging the entrance of the opening 12*b* when the fitting part 30*a* is fitted on the outer peripheral surface of the resin case main body 12.

The positioning ring (the boundary ring) 19 and the watch module 14 are inserted into the storage space 12*f* in this order through the opening 12*d* of the back surface 12*e* with the display unit 14*a* of the watch module 14 facing the opening 12*b* of the opening forming surface 12*c*, and are retained at the predetermined positions in the storage space 12*f*.

Subsequently, the opening 12*d* of the back surface 12*e* is covered with the back cover 18 with the waterproof ring 16, and the back cover 18 is detachably fixed on the back surface 12*e* by the known fixing means such as, for example, the fixing screws.

Next, the annular elastic member 26 is mounted on the step 24 of the inner peripheral surface of the opening 12*b* through the opening 12*b* of the opening forming surface 12*c* of the resin case main body 12, so that the annular elastic member 26 on the step 24 is provided along the inner peripheral surface of the opening 12*b*.

Then, the fitting part 30*a* of the frame member 30 which is previously prepared as described above is press-fitted on the portion of the outer peripheral surface 12*a* of the resin case main body 12, the portion being adjacent to the opening forming surface 12*c*. Moreover, the elastic member pressing part 30*b* which extends from the fitting part 30*a* of the frame member 30 towards the entrance of the opening 12*b* of the resin case main body 12 to overhang the entrance of the opening 12*b* is made to cover at least the part of the elastic member 26 at the entrance of the opening 12*b*. In the present embodiment, the elastic member pressing part 30*b* of the frame member 30 covers at least ½ of the dimension of the elastic member 24 in the direction directing from the circumferential edge of the entrance of the opening 12*b* of the resin case main body 12 towards the center of the entrance of the opening 12*b*.

Furthermore, the light transmission member 28 for covering the opening 12*b* is press-fitted in the opening 12*b* of the opening forming surface 12*c* of the resin case main body 12 via the inclined or curved surface 26 of the part of the elastic member 26, the part being adjacent to the opening forming surface 12*c*, so that the elastic member 26 is interposed between the outer periphery of the light transmission member 28 and the inner peripheral surface of the opening 12*b*. By this press-fitting, the elastic member 26 is compressed in the radial direction of the opening 12*b* and is further pushed towards the surface of the step 24. As a result, the outer periphery of the light transmission member 28 is brought into close contact with the inner periphery of the annular elastic member 26, the outer periphery of the annular elastic member 26 is brought into close contact with the inner peripheral surface of the opening 12*b*, and further the basal part of the annular elastic member 26 is brought into close contact with the surface of the step 24 of the inner peripheral surface of the opening 12*b*. The compressed elastic member 26 increases friction resistance to the outer periphery of the light transmission member 28 and the inner peripheral surface of the opening 12*b* to prevent the light transmission member 28 from falling out from the opening 12*b* of the opening forming surface 12*c* of the resin case main body 12.

Lastly, the exterior member 32 is mounted on the outward surface of the elastic member pressing part 30*b* of the frame member 30 with the impact cushioning member 34. The exterior member 32 covers the outer peripheral surface of the fitting part 30*a* of the frame member 30, the outward surface of the elastic member pressing part 30*b* of the frame member 30, and the outer peripheral surface 12*a* of the resin case main body 12, and is fixed to the outer peripheral surface 12*a* of the resin case main body 12 by the desired fixing member.

In another example of the method for assembling the case unit 10, an order between the mounting of the elastic member 26 on the step 24 in the opening 12*b* of the opening forming surface 12*c* of the resin case main body 12 and the fitting for press fitting the fitting part 30*a* of the frame member 30 on the part of the outer peripheral surface 12*a* of the resin case main body 12, the part being adjacent to the opening forming surface 12*c*, can be reversed.

In other words, after the fitting part 30*a* of the frame member 30 is fitted by the press fitting on the part of the outer peripheral surface 12*a* of the resin case main body 12, the part being adjacent to the opening forming surface 12*c*, the elastic member 26 is mounted on the step 24 in the opening 12*b* of the opening forming surface 12*c* of the resin case main body 12 to provide the elastic member 26 along the inner peripheral surface of the opening 12*b*. At that time, the at least part of the elastic member 26 on the step 24 is covered by the elastic member pressing part 30*b* of the frame member 30 at the entrance of the opening 12*b*, as described above. Lastly, the outer periphery of the light transmission member 28 for covering the opening 12*b* is press-fitted in the inner periphery of the elastic member 26 in the opening 12*b* of the resin case main body 12.

In addition, according to the concept of the present invention, each of a planar shape of the outer peripheral surface of the resin case main body 12 and a planar shape of the opening 12*b* of the opening forming surface 12*c* of the resin case main body 12 may have a circular shape, an elliptical shape, a polygonal shape or any other wide-variety of desired shape.

Moreover, the case unit with the opening covered with the light transmission member may be apparently employed for each of case units of many other widely different types besides the above described case unit 10 for a wristwatch. The case units of many other widely different types may include, for example, a case unit for a cellular phone, a case unit for a PDA (Personal data assistance), a case unit for a portable audio player, a case unit for a portable or small-sized radio and the like.

Further, the portable apparatus may be apparently employed for each of the portable apparatuses of many other widely different types besides the above described wristwatch 100. The portable apparatuses of many other widely different types may include, for example, a cellular phone, a PDA (Personal data assistance), a portable audio player, a portable or small-sized radio and the like.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A case unit comprising:

a resin case main body which includes an outer peripheral surface, and an opening forming surface enclosed by the outer peripheral surface and being formed with an opening;

a step which is provided on an inner peripheral surface of the opening of the resin case main body and which faces an entrance of the opening;

an elastic member which is provided along the inner peripheral surface of the opening of the resin case main body and which is mounted on the step;

a light transmission member which includes an outer periphery, which is press-fitted in the opening of the resin case main body with the elastic member being interposed between the outer periphery of the light transmission, member and the inner peripheral surface of the opening of the resin case main body, and which covers the opening; and a frame member which includes a fitting part fitted on the outer peripheral surface of the resin case main body and an elastic member pressing part extending from the fitting part towards the entrance of the opening of the resin case main body and covering at least a part of the elastic member at the entrance of the opening, wherein the fitting of the fitting part of the frame member on the outer peripheral surface of the resin case main body is performed by press fit.

2. The case unit according to claim 1, wherein the elastic member pressing part of the frame member covers at least ½ of a dimension of the elastic member in a direction directing from a circumferential edge of the entrance of the opening towards a center of the entrance of the opening.

3. The case unit according to claim 1, wherein the elastic member pressing part of the frame member extends annularly along a circumferential edge of the entrance of the opening.

4. The case unit according to claim 1, wherein an elasticity of the frame member is smaller than an elasticity of the resin case main body.

5. The case unit according to claim 4, wherein the frame member is made of a metal.

6. The case unit according to claim 1, wherein the case unit is for a portable watch including a wristwatch.

7. A portable apparatus comprising:

a case unit having an opening;

a function unit stored in the opening of the case unit; and a light transmission member having an outer periphery and covering the opening of the case unit, the case unit comprising:

a resin case main body which includes an outer peripheral surface, and an opening forming surface enclosed by the outer peripheral surface and being formed with the opening;

a step which is provided on an inner peripheral surface of the opening of the resin case main body and which faces an entrance of the opening;

an elastic member which is provided along the inner peripheral surface of the opening of the resin case main body, which is mounted on the step, which is pressed by the outer periphery of the light transmission member when the light transmission member is press-fitted in the opening to cover the opening, and which is interposed between the outer periphery of the light transmission member and the inner peripheral surface of the opening of the resin case main body; and a frame member which includes a fitting part fitted on the outer peripheral surface of the resin case main body and an elastic member pressing part extending from the fitting part towards the entrance of the opening of the resin case main body and covering at least a part of the elastic member at the entrance of the opening, wherein the fitting of the fitting part of the frame member on the outer peripheral surface of the resin case main body is performed by press fit.

8. The portable apparatus according to claim 7, wherein the elastic member pressing part of the frame member of the case unit covers at least ½ of a dimension of the elastic member in a direction directing from a circumferential edge of the entrance of the opening towards a center of the entrance of the opening.

9. The portable apparatus according to claim 7, wherein the elastic member pressing part of the frame member of the case unit extends annularly along a circumferential edge of the entrance of the opening.

10. The portable apparatus according to claim 7, wherein an elasticity of the frame member of the case unit is smaller than an elasticity of the resin case main body of the case unit.

11. The portable unit according to claim 10, wherein the frame member of the case unit is made of a metal.

12. The portable apparatus according to claim 7, wherein the function unit includes a time piece module functioning as a time measuring unit, and the case unit is for a portable watch including a wristwatch.

13. A method for assembling a case unit comprising:

preparing a resin case main body which includes an outer peripheral surface, an opening forming surface enclosed by the outer peripheral surface and being formed with an opening, and a step provided on an inner peripheral surface of the opening and facing an entrance of the opening;

preparing a frame member which includes a fitting part to be fitted on the outer peripheral surface of the resin case main body and an elastic member pressing part which extends from the fitting part towards the entrance of the opening of the resin case main body and which overhangs the entrance of the opening, when the fitting part is fitted on the outer peripheral surface of the resin case main body;

performing one of mounting an elastic member which is configured to be provided along the inner peripheral surface of the opening of the resin case main body, on the step, and press-fitting the fitting part of the frame member on the outer peripheral surface of the resin case main body;

performing the other of the mounting of the elastic member on the step, and the press-fitting of the fitting part of the frame member on the outer peripheral surface of the resin case main body, so that at least a part of the elastic member is covered with the elastic member pressing part of the frame member at the entrance of the opening; and press-fitting a light transmission member which includes an outer periphery, in the opening of the resin case main body with the elastic member being interposed between the outer periphery of the light transmission member and the inner peripheral surface of the opening of the resin case main body, to cover the opening.

* * * * *